US008948648B2

(12) United States Patent
Ito et al.

(10) Patent No.: US 8,948,648 B2
(45) Date of Patent: Feb. 3, 2015

(54) DEVELOPING DEVICE PROVIDED WITH SEALING MEMBERS ASSEMBLED TO THICKNESS-REGULATION MEMBER

(75) Inventors: Yoshinori Ito, Toyokawa (JP); Satoru Suzuki, Kasugai (JP); Masashi Imai, Kasugai (JP); Ryuya Yamazaki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 719 days.

(21) Appl. No.: 13/233,544

(22) Filed: Sep. 15, 2011

(65) Prior Publication Data

US 2012/0082476 A1 Apr. 5, 2012

(30) Foreign Application Priority Data

Sep. 30, 2010 (JP) ..... 2010-220568

(51) Int. Cl.
*G03G 15/08* (2006.01)

(52) U.S. Cl.
CPC .... *G03G 15/0812* (2013.01); *G03G 2215/0634* (2013.01)
USPC ..... 399/103

(58) Field of Classification Search
CPC ..... G03G 15/0812; G03G 15/0817
USPC ..... 399/103, 284
See application file for complete search history.

(56) References Cited

U.S. PATENT DOCUMENTS

| | | | |
|---|---|---|---|
| 5,057,868 | A | 10/1991 | Sekino et al. |
| 5,287,150 | A | 2/1994 | Kinoshita et al. |
| 6,094,550 | A | 7/2000 | Kido et al. |
| 2005/0158070 | A1 | 7/2005 | Ishii |
| 2009/0274481 | A1 | 11/2009 | Xu et al. |
| 2012/0082477 | A1 | 4/2012 | Ito |

FOREIGN PATENT DOCUMENTS

| | | | |
|---|---|---|---|
| JP | H02-210475 | A | 8/1990 |
| JP | H05-307326 | A | 11/1993 |
| JP | H06-011958 | A | 1/1994 |
| JP | H09-022185 | A | 1/1997 |
| JP | H11-073017 | A | 3/1999 |
| JP | 2005-189346 | A | 7/2005 |
| JP | 2009-265574 | A | 11/2009 |

*Primary Examiner* — Erika J Villaluna
(74) *Attorney, Agent, or Firm* — Merchant & Gould PC

(57) ABSTRACT

A developing device includes a casing having an opening extending in a first direction, a developing roller, a thickness-regulation member, an engagement portion and a sealing member. The thickness-regulation member includes a thin-plate member and a regulating portion. The thin-plate member is fixed to the casing and has a lateral end extending in a second direction. The regulating portion is fixed on the thin-plate member and has an end face extending in a direction. The engagement portion is fixed on the thin-plate member and positioned closer to the lateral end than the end face to the lateral end to provide a groove between the engagement portion and the end face. The sealing member is fitted in the groove and has a length in the first direction longer than a length of the groove prior to assembly of the sealing member into the groove.

10 Claims, 11 Drawing Sheets

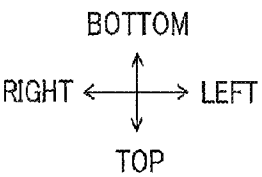
FIG.5B
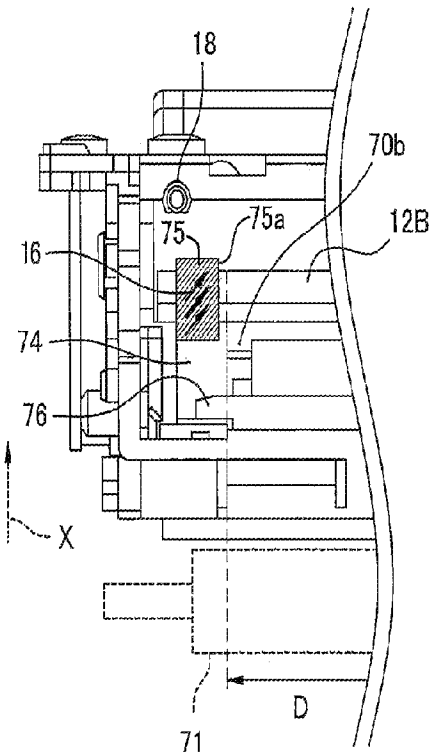
FIG.5C
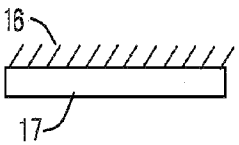
FIG.5A
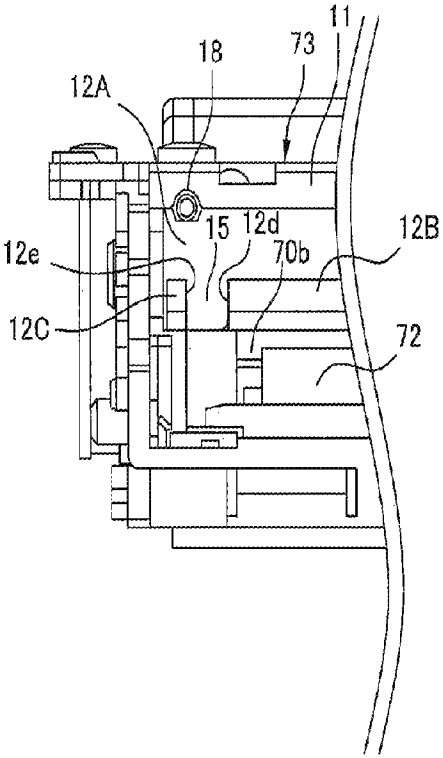

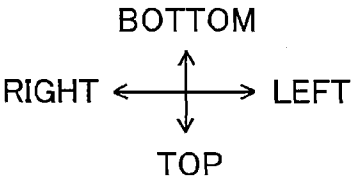
FIG.7B
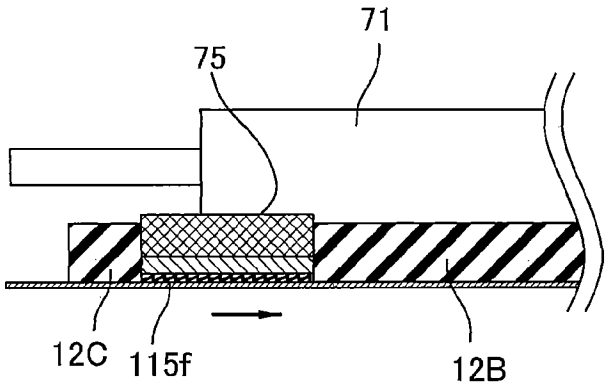
FIG.7A
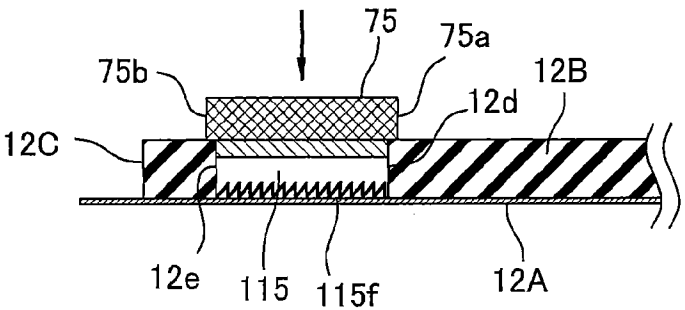

DEVELOPING DEVICE PROVIDED WITH SEALING MEMBERS ASSEMBLED TO THICKNESS-REGULATION MEMBER

CROSS REFERENCE TO RELATED APPLICATION

This application claims priority from Japanese Patent Application No. 2010-220568 filed Sep. 30, 2010. The entire content of the priority application is incorporated herein by reference.

TECHNICAL FIELD

The present invention relates to an image forming device, and also to a developing device and a process unit mountable on the image forming device.

BACKGROUND

In a conventional electrophotographic image forming device, an electrostatic latent image is formed on a photosensitive drum. Toner accommodated within a developing cartridge is supplied to the electrostatic latent image, thereby forming a toner image on the photosensitive drum. The toner image is then transferred onto a sheet to form an image on the sheet.

One of such conventional developing cartridges includes a casing, a toner accommodation chamber for storing toner therein, a developing roller rotatably supported to the casing, a thickness-regulating member for regulating a thickness of toner carried on the developing roller and sealing members for preventing toner from leaking outside. The thickness-regulating member includes a leaf spring whose one end is fixed to the casing and a thickness regulating portion fixed to the other end of the leaf spring. The sealing members are disposed on both widthwise ends of the developing roller and are attached to the leaf spring.

In the developing cartridge of the above configuration, the sealing members are carefully attached to the leaf spring for sealing a groove between each sealing member and the thickness regulating portion in order to prevent toner leakage. The sealing members are attached by a double-sided adhesive tape with extreme care.

SUMMARY

However, attaching the sealing members to the leaf spring via the double-sided adhesive tape requires high accuracy in positioning the sealing members. Attachment of the sealing members therefore involves cumbersome efforts.

In view of the foregoing, it is an object of the invention to provide a developing device in which sealing members can be easily assembled to a thickness-regulating member, a process unit incorporating the developing device and an image forming device provided with the process unit.

In order to attain the above and other objects, there is provided a developing device including a casing, a developing roller, a thickness-regulation member, an engagement portion and a sealing member. The casing has an opening an opening extending in a first direction. The developing roller is positioned adjacent to the opening and is configured to rotate about an axis extending in the first direction. The developing roller has an outer circumferential surface on which developer is carried. The thickness-regulation member includes: a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion, the regulating portion being in contact with the outer circumferential surface of the developing roller via the developer for regulating thickness of the developer on the outer circumferential surface, the regulating portion having an end face extending in a direction crossing the first direction. The engagement portion is fixed on the thin-plate member and positioned closer to the lateral end than the end face to the lateral end to provide a groove between the engagement portion and the end face, the groove having a length in the first direction. The sealing member is fitted in the groove for suppressing leakage of the developer from the casing, the sealing member having a length in the first direction longer than the length of the groove prior to assembly of the sealing member into the groove.

According to another aspect of the present invention, there is provided a process unit including a photosensitive member having a circumferential surface on which an electrostatic latent image is formed, and a developing device for supplying developer to the electrostatic latent image. The developing device includes a casing, a developing roller, a thickness-regulation member, an engagement portion and a sealing member. The casing has an opening extending in a first direction. The developing roller is positioned adjacent to the opening and is configured to rotate about an axis extending in the first direction. The developing roller has an outer circumferential surface on which developer is carried. The thickness-regulation member includes: a thin-plate member extending in the first direction along the opening and having a base end portion fixed to the casing and extending in the first direction and a free end portion, the thin-plate member having a lateral end, extending in a second direction crossing the first direction; and a regulating portion extending in the first direction and fixed to the free end portion, the regulating portion being in contact with the outer circumferential surface of the developing roller via the developer for regulating thickness of the developer on the outer circumferential surface, the regulating portion having an end face extending in a direction crossing the first direction. The engagement portion is fixed on the thin-plate member and positioned closer to the lateral end than the end face to the lateral end to provide a groove between the engagement portion and the end face, the groove having a length in the first direction. The sealing member is fitted in the groove for suppressing leakage of the developer from the casing, the sealing member having a length in the first direction longer than the length of the groove prior to assembly of the sealing member into the groove.

According to still another aspect of the present invention, there is provided an image forming device including a process unit, an exposure unit, a transfer unit and a fixing unit. The process unit includes a photosensitive member having a circumferential surface on which an electrostatic latent image is formed, and a developing device for supplying developer to the electrostatic latent image. The an exposure unit exposes a scanned light to the photosensitive member, the transfer unit transfers a developer image formed in the process unit to a sheet, and the fixing unit fixes the developer image to the sheet. The developing device of the process unit includes a casing, a developing roller, a thickness-regulation member, an engagement portion and a deformable sealing member. The casing has an opening extending in a first direction. The developing roller is positioned adjacent to the opening and is configured to rotate about an axis extending in the first direction. The developing roller has an outer circumferential surface on which developer is carried. The thickness-regulation member includes: a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion, the regulating portion being in contact with the outer circumferential surface of the developing roller via the developer for regulating thickness of the developer on the outer circumferential surface, the regulating portion having an end face extending in a direction crossing the first direction. The engagement portion is fixed on the thin-plate member and positioned closer to the lateral end than the end face to the lateral end to provide a groove between the engagement portion and the end face, the groove having a length in the first direction. The sealing member is fitted in the groove for suppressing leakage of the developer from the casing, the sealing member having a length in the first direction longer than the length of the groove prior to assembly of the sealing member into the groove.

BRIEF DESCRIPTION OF THE DRAWINGS

In the drawings:

FIG. 5A is a partially enlarged schematic view showing a right end portion of the developing cartridge of FIG. 2 as viewed from below, wherein the blade sealing member is not yet assembled to the leaf spring and a groove according to the embodiment formed on the leaf spring is exposed;

FIG. 5B is a partially-enlarged schematic view showing the right end portion of the developing cartridge of FIG. 2 as viewed from below, wherein the blade sealing member has been assembled to the groove;

FIG. 5C is a conceptual cross-sectional view of the blade sealing member;

FIG. 7A is a partially-enlarged schematic view showing a groove according to a first modification of the embodiment as viewed from its front side, wherein the blade sealing member is about to be assembled to the groove;

FIG. 7B is a partially-enlarged schematic view showing the groove according to the first modification of the embodiment as viewed from its front side, wherein the blade sealing member has been assembled to the groove and the developing roller has been assembled to the developing cartridge;

DETAILED DESCRIPTION

First, a general configuration of a color laser printer 1 according to an embodiment of the present invention will be described with reference to FIG. 1.

Throughout the specification, the terms "above", "below", "right", "left", "front", "rear" and the like will be used assuming that the color laser printer 1 is disposed in an orientation in which it is intended to be used. More specifically, in FIG. 1, a right side, a left side, a near side and a far side will be referred to as a front side, a rear side, a left side and a right side, respectively.

Figure 1:
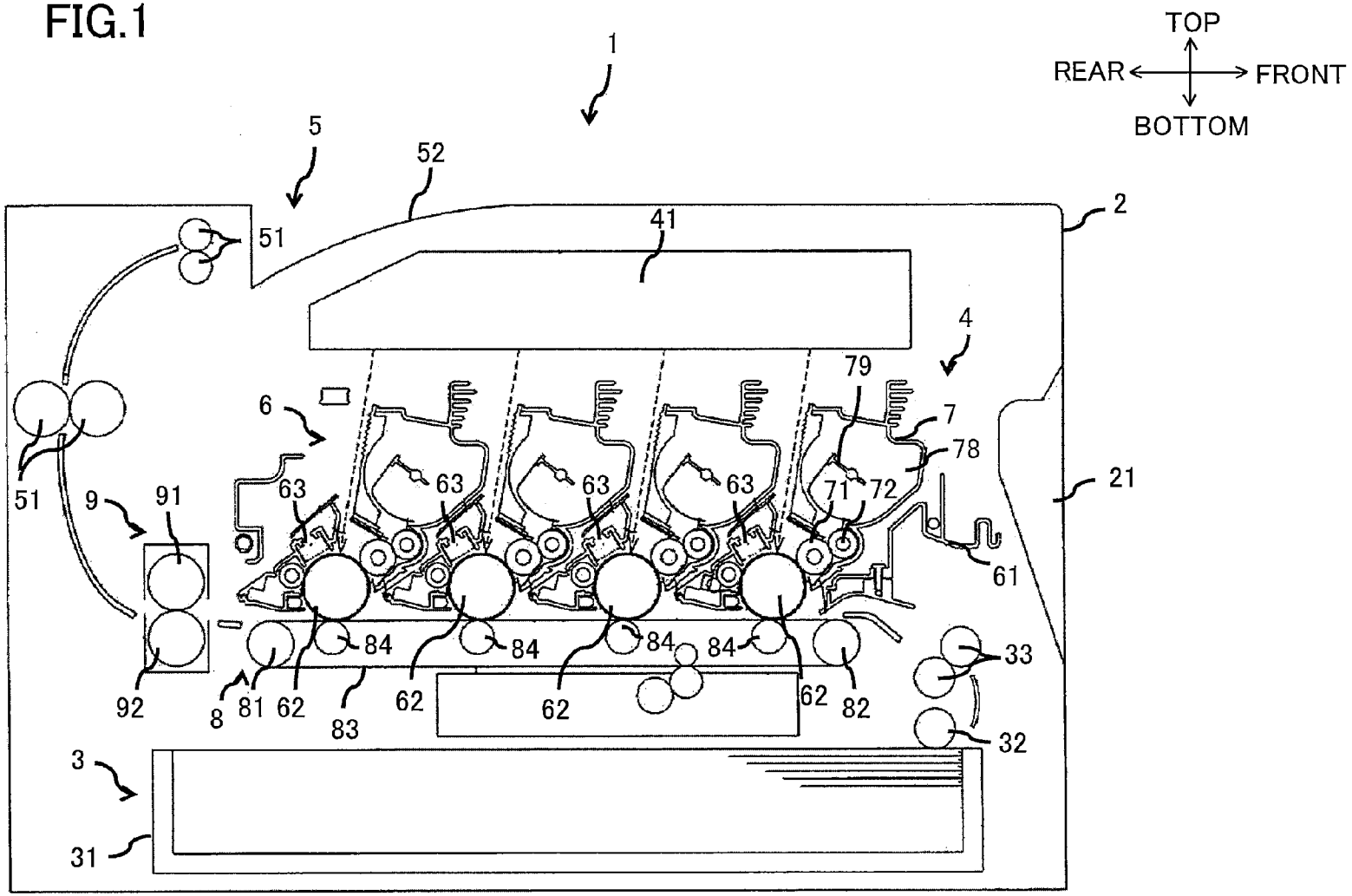
FIG. 1 is a side cross-sectional view illustrating a general configuration of a color laser printer incorporating a developing cartridge according to an embodiment of the present invention, the developing cartridge including a developing roller.

As shown in FIG. 1, the color laser printer 1 includes a main frame 2 within which a sheet supplying unit 3, an image forming unit 4, and a sheet discharging unit 5 are provided.

A movable front cover 21 is pivotally movably supported to a lower front end portion of the main frame 2 so as to cover and expose an opening formed on a front side of the main frame 2.

The sheet supplying unit 3 is disposed at a lower portion of the main frame 2. The sheet supplying unit 3 includes a sheet tray 31 for accommodating sheets therein, a sheet supply roller 32, and a pair of registration rollers 33. Each sheet accommodated in the sheet tray 31 is separated one by one and conveyed toward the image forming unit 4.

The image forming unit 4 includes an exposing section 41, a processing section 6, a transferring section 8 and a fixing section 9.

The exposing section 41 is disposed at an upper portion of the main frame 2. The exposure unit 4 includes a laser emitting portion, a polygon mirror, lenses and reflection mirrors (all now shown in FIG. 1). In this exposing section 41, a laser beam emitted from the laser emitting portion based on image data is scanned in a left-to-right direction by the polygon mirror at a high speed, passes through or reflected by the lens and the reflection mirrors, and is irradiated onto each photosensitive drum 62 (described later).

The processing section 6 is disposed below the exposing section 41 and above the sheet supplying unit 3. The processing section 6 includes a unit main body 61, and four developing cartridges 7 each storing toner of one of four colors used in the color laser printer 1: black, yellow, magenta and cyan.

The unit main body 61 includes four drum sub-units juxtaposed in a front-to-rear direction. Each drum sub-unit corresponds to each of the four developing cartridges 7 and includes the photosensitive drum 62 and a Scorotron charger 63.

The developing cartridges 7 for the colors of black, yellow, magenta and cyan are juxtaposed in this order, from upstream to downstream in a sheet conveying direction. Each developing cartridge 7 stores toner of a different color but has a configuration identical to one another.

Each developing cartridge 7 includes a developing casing 70 (see FIG. 2), a developing roller 71, a supply roller 72 and a toner accommodating chamber 78. The developing roller 71 is rotatably supported to the developing casing 70. The supply roller 72 supplies toner to the developing roller 71. The toner accommodating chamber 78 stores toner therein.

The developing roller 71 is configured of a roller shaft made of a metal, and a covering portion made of an electrically-conductive rubber material to cover the roller shaft. More specifically, the covering portion has a circumferential surface made of an electrically-conductive urethane runner or a silicon rubber including carbon particles, and the circumferential surface is covered with a coating layer made of urethane rubber or a silicon rubber including fluorine. The covering portion is brought into contact with the photosensitive drum 62.

The supply roller 72 is configured of a roller shaft made of a metal, and a covering portion covering the roller shaft and made of an electrically-conductive foamed material.

The toner accommodating chamber 78 stores therein non-magnetic monocomponent polymeric toner. Polymeric toner has a substantially spherical shape and has a high liquidity. Within the toner accommodating chamber 78, an agitator 79 is also provided for agitating the toner accommodated in the toner accommodating chamber 78.

In the processing section 6, the Scorotron charger 63 uniformly charges a surface of the photosensitive drum 62. The high-speed scanning of the laser beam emitted from the exposing section 41 then exposes the charged surface of the photosensitive drum 62 so that an electrostatic latent image is formed thereon. In the meantime, the toner stored in the toner accommodating chamber 78 is supplied to the developing roller 71 via the supply roller 72 and is tribocharged between the supply roller 72 and the developing roller 71. The toner is then supplied to the electrostatic latent image formed on the surface of the photosensitive drum 62 to form a toner image thereon.

The transferring section 8 is disposed above the sheet supplying unit 3 and below the processing section 6. The transferring section 8 includes a drive roller 81, a follower roller 82, an endless conveyor belt 83 and four transfer rollers 84.

The drive roller 81 and the follower roller 82 are disposed horizontally in opposition to each other. The conveyor belt 83 is mounted on the drive roller 81 and the follower roller 82 in a taut state. The conveyor belt 83 has an outer circumferential surface with which each of the photosensitive drums 62 is in contact. The conveyor belt 83 has an internal space within which the four transfer rollers 84 are disposed in correspondence with the photosensitive drums 62. The conveyor belt 83 is nipped between each pair of the transfer roller 84 and the photosensitive drum 62.

In the transferring section 8, at the time of image formation, when each sheet conveyed on the conveyor belt 83 passes between the photosensitive drum 62 and the transfer roller 84, the sheet is applied with a transfer bias from each transfer roller 84 to transfer the toner image carried on the surface of the photosensitive drum 62 onto the sheet.

The fixing section 9 is disposed rearward of the developing cartridges 7. The fixing section 9 includes a heat roller 91 and a pressure roller 92. The heat roller 91 is heated due to heat generated from a heat source (not shown) and the heat roller 91 is in pressure contact with the heat roller 91.

In the fixing section 9, when the toner image transferred on the sheet is thermally fixed thereon while the sheet passes between the heat roller 91 and the pressure roller 92.

The sheet discharging unit 5 includes discharge rollers 51 and a discharge tray 52. The image-formed sheet conveyed from the fixing section 9 is conveyed by the discharge rollers 51 and is finally discharged onto the discharge tray 52.

Next, a detailed configuration of the developing cartridge 7 according to the embodiment will be described with reference to FIGS. 2 through 7. Hereinafter, descriptions will be given assuming that the developing cartridge 7 is mounted in the main frame 2.

Figure 2:
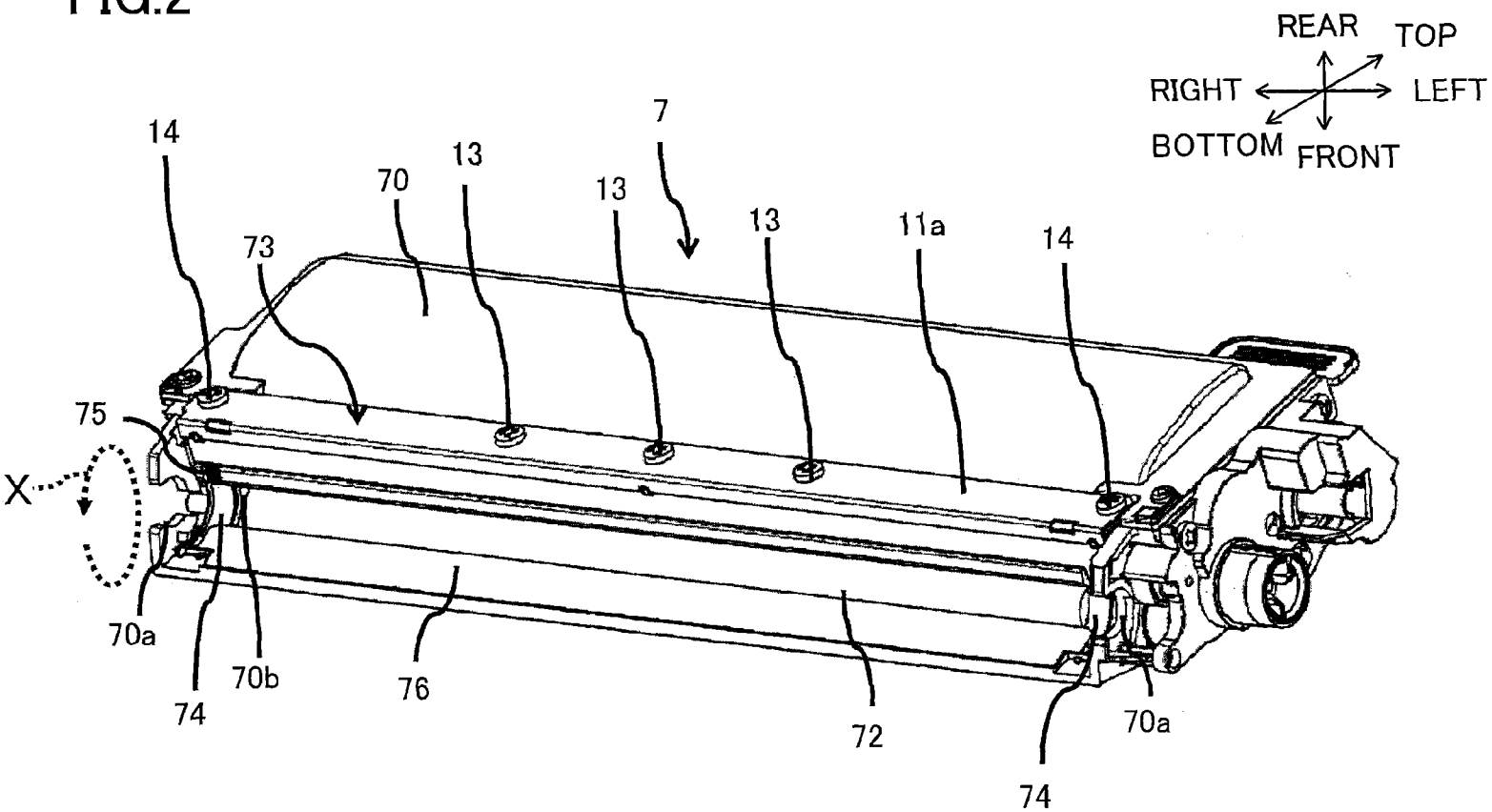
FIG. 2 is a perspective view of the developing cartridge according to the embodiment as viewed from a side rearward and diagonally downward of the developing cartridge, wherein the developing cartridge includes a blade unit and two blade sealing members but one of the blade sealing members and the developing roller are not shown.

As shown in FIG. 2, the developing cartridge 7 includes the developing casing 70, the developing roller 71 (omitted in FIG. 2), the supply roller 72, a blade unit 73, two side sealing members 74, a lower film 76 and two blade sealing members 75 (only one is show in FIG. 2).

The developing casing 70 includes two bearing portions 70*a* for rotatably supporting the roller shaft of the developing roller 71, an opening 70*b*, two side seal attachment portions and a lower film attachment portion.

The opening 70*b* has a substantially rectangular shape elongated in the left-to-right direction (i.e., an axial direction of the roller shaft of the developing roller 71). The opening 70*b* is provided for supplying toner within the toner accommodating chamber 78 to the developing roller 71 via the supply roller 72.

Each side seal attachment portion is respectively provided outward of each widthwise end portions of the opening 70*b* in the left-to-right direction. The side sealing members 74 are attached to the side seal attachment portions. The lower film 76 is attached to the lower film attachment portion.

Each side sealing member 74 is resiliently deformable and is disposed to be in sliding contact with each widthwise end portion of the covering portion of the developing roller 71. The lower film 76 slidingly contacts a lower portion of the covering portion of the developing roller 71. The developing roller 71 is configured to rotate in a rotational direction X shown in FIG. 2 such that the covering portion of the developing roller 71 can slidingly contact with the lower film 76, the side sealing members 74 and the blade sealing member 75 sequentially in this order.

Figure 3:
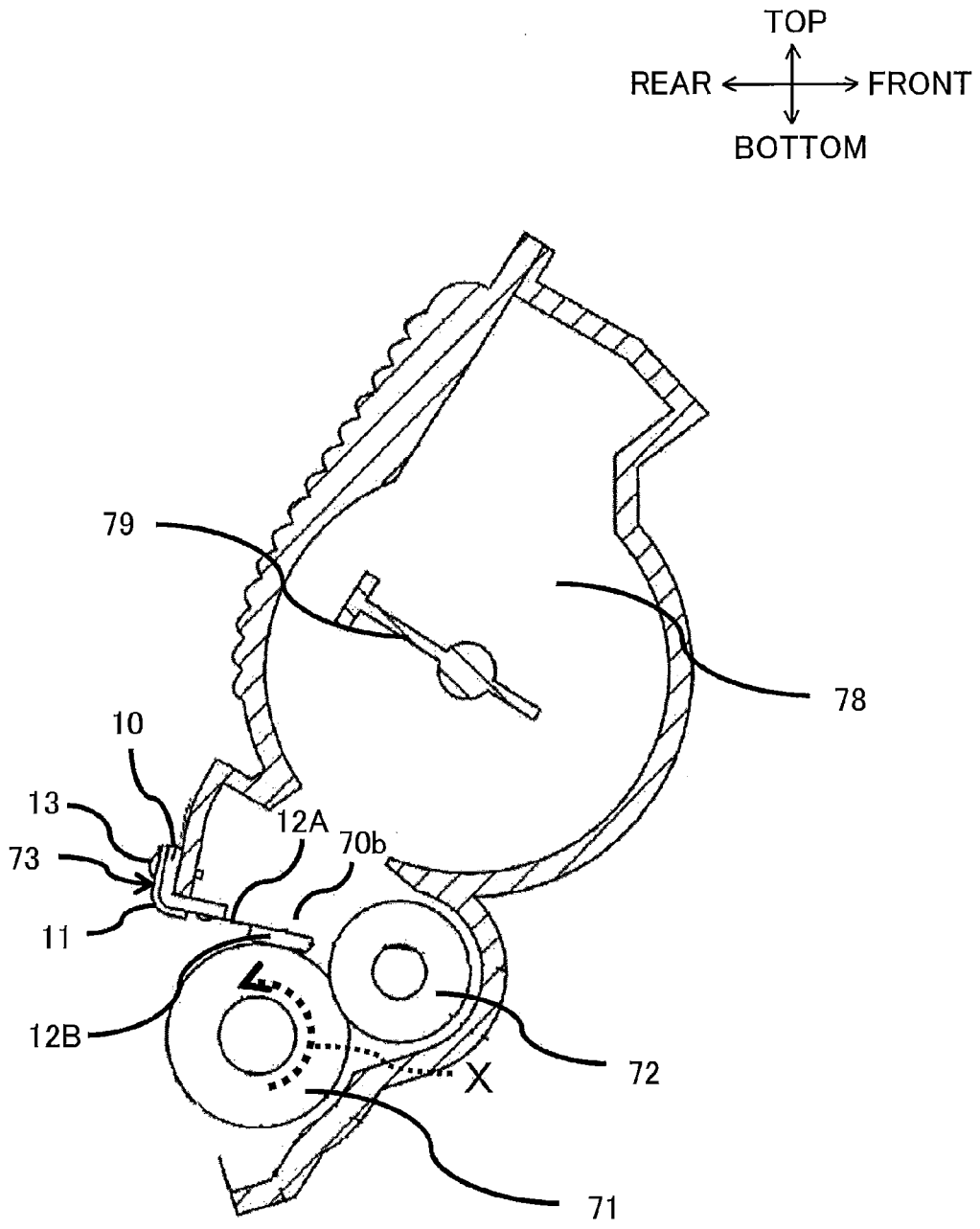
FIG. 3 is a central cross-sectional view of the developing cartridge according to the embodiment.

The blade unit 73 is fixed to the developing casing 70 at a position upward of and rearward of the opening 70*b*, as shown in FIGS. 2 and 3.

Figure 4:
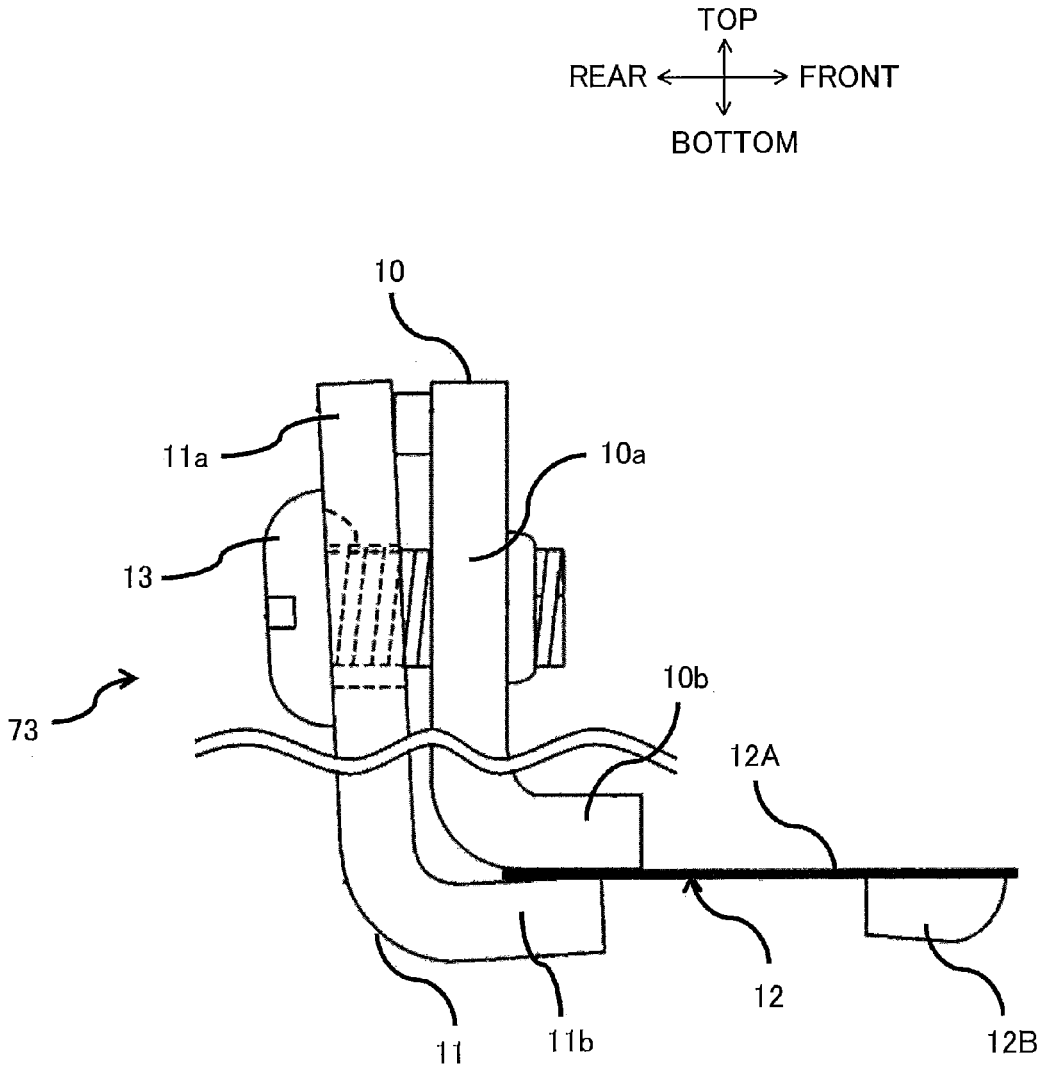
FIG. 4 is a schematic view showing a detailed configuration of the blade unit of FIGS. 2 and 3, wherein the blade unit includes a leaf spring and a pressing portion formed on the leaf spring.

The blade unit 73 extends in the left-to-right direction as shown in FIG. 2, and includes a thickness-regulation blade 12, a blade holder 10 and a blade reinforcing plate 11, as shown in FIG. 4.

The thickness-regulation blade 12 is a member for regulating a thickness of toner carried on the circumferential surface of the covering portion of the developing roller 71. Detailed configuration will be later described.

The blade holder 10 and the blade reinforcing plate 11 are fabricated respectively by bending a metal plate-like member at a substantially right angle. The blade holder 10 and the blade reinforcing plate 11 extend in the left-to-right direction to nip the thickness-regulation blade 12 therebetween.

More specifically, referring to FIGS. 2 and 4, the blade holder 10 is configured of a holding portion 10*a* and a nipping portion 10*b* extending substantially frontward from the holding portion 10*a*. Likewise, the blade reinforcing plate 11 is configured of a holding portion 11*a* and a nipping portion 11*b* extending substantially frontward from the holding portion 11*a*. Each of the holding portions 10*a*, 11*a* has a substantially rectangular plate-like shape elongated in the left-to-right direction whose short side is oriented in a substantially vertical direction. Each of the nipping portions 10*b*, 11*b* has a substantially rectangular plate-like shape elongated in the left-to-right direction whose short side is oriented substantially frontward.

Each of the holding portions 10*a*, 11*a* has widthwise end portions in the left-to-right direction on each of which a fixing hole (not shown) is formed. A fixing screw 14 is screwed into each fixing hole to fix the blade unit 73 to the developing casing 70, as shown in FIG. 2. Each of the holding portions 10*a*, 11*a* also has a central portion in the left-to-right direction on which a plurality of adjusting holes (not shown) are formed. An adjusting screw 13 is screwed into each adjusting hole such that a force to nip the thickness-regulation blade 12 between the nipping portions 10*b*, 11*b* can be adjusted in the blade unit 73.

The nipping portion 10*b* of the blade holder 10 has widthwise end portions in the left-to-right direction on each of which a boss is formed for positioning the thickness-regulation blade 12 on the blade holder 10.

The thickness-regulation blade 12 includes a leaf spring member 12A, a pressing portion 12B and two engagement portions 12C, as shown in FIGS. 2 through 5.

The leaf spring member 12A has a substantially rectangular thin plate-like shape extending in the left-to-right direction. The leaf spring member 12A is made of a thin metal plate such as a stainless (rustless) steel. The leaf spring member 12A has widthwise end portions in the left-to-right direction on each of which an engaging hole 18 is formed (see FIG. 5B). Each engaging hole 18 is engageable with the boss formed on each widthwise end portion of the nipping portion 10*b* of the blade holder 10.

The pressing portion 12B is formed of an elastic rubber, such as a silicon rubber. The pressing portion 12B is fixed to the leaf spring member 12A, more specifically, to a lower tip end portion of the leaf spring member 12A. As shown in FIG. 5B, the pressing portion 12B extends in the left-to-right direction to have a length longer than a region D of the covering portion of the developing roller 71 in the left-to-right direction, the region D corresponding to a maximum width of a sheet that can be used in the color laser printer 1.

As shown in FIG. 3, the pressing portion 12B is in pressure contact with the circumferential surface of the covering portion of the developing roller 71 due to a resilient force of the leaf spring member 12A. The pressing portion 12B is thus in contact with the developing roller 71 via a layer of toner formed thereon, thereby regulating thickness of the toner layer.

Each engagement portion 12C is disposed outward of each widthwise end portion of the pressing portion 12B in the left-to-right direction. Just as the pressing portion 12B, the engagement portion 12C is formed of an elastic rubber, such as a silicon rubber. The engagement portions 12C are fixed to the leaf spring member 12A such that each engagement portion 12C is out of contact with each widthwise end portion of the covering portion of the developing roller 71 when the developing roller 71 is assembled to the developing casing 70, as shown in FIG. 5B.

Figure 6:
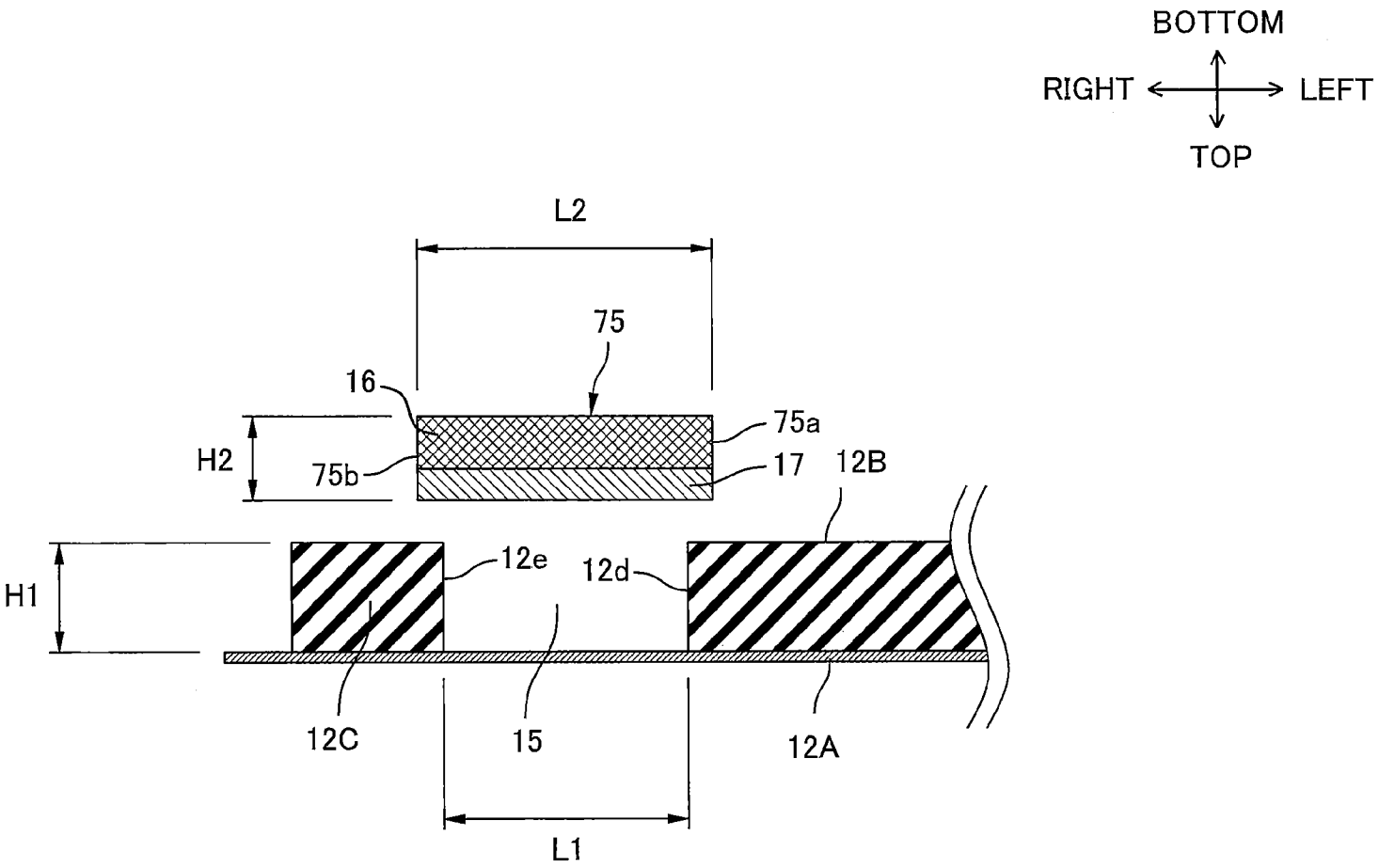
FIG. 6 is a partially-enlarged schematic view showing a right end portion of the leaf spring of FIG. 2 as viewed from its front side to illustrate how the blade sealing member is assembled to the groove.

As shown in FIG. 6, each engagement portion 12C is disposed in separation from the pressing portion 12B by a distance L1 in the left-to-right direction. Further, as will be described later, each engagement portion 12C is disposed outward of the blade sealing member 75 in the left-to-right direction. In other words, as shown in FIGS. 5B and 6, each engagement portion 12C is fixed on the leaf spring member 12A at a position outward of the side seal attachment portion which is positioned outward of widthwise end portion of the opening 70*b* in the left-to-right direction, thereby forming a groove 15 between each widthwise end portion of the pressing portion 12B and each engagement portion 12C. Each groove 15 has a length L1 (i.e., the distance L1) in the left-to-right direction.

More specifically, as shown in FIG. 6, the groove 15 is a space defined between an outer wall section 12*d* of the pressing portion 12B and an inner wall section 12*e* of the engagement portion 12C in the left-to-right direction, the outer wall section 12*d* and the inner wall section 12*e* being substantially parallel to each other. In the present embodiment, the groove 15 has the length L1 of 4.85 mm in the left-to-right direction and a depth (length) H1 of 1.5 mm in the vertical direction. That is, the pressing portion 12B and the engagement portion 12C have a height equal to each other (i.e., the depth H1).

The engagement portion 12C of the above configuration has a hardness of eighty (80) degrees as a result of measurement by a durometer (CL-150, a product of KOBUNSHI KEIKI co, ltd.).

The pressing portion 12B and the engagement portions 12C are manufactured by injection molding. Specifically, the leaf spring member 12A is inserted into a metal mold, and an elastic material for forming the pressing portion 12B and the engagement portions 12C (silicon rubber in the embodiment) is subsequently injected into the mold. In this way, the pressing portion 12B and the engagement portions 12C are formed on the leaf spring member 12A.

The side sealing members 74 serve to prevent toner from leaking outside from the widthwise end portions of the opening 70*b* in the left-to-right direction, as shown in FIG. 2. Each side sealing member 74 is configured of a base member and a surface member (not shown). Specifically, the base member is formed of an elastically deformable material, such as urethane sponge, whose hardness is lower than that of the surface member. The surface member is formed of a material having a thickness smaller than that of the base member, such as felt. The surface member is attached to the base member by, for example, a double-sided adhesive tape. Each side sealing member 74 is attached to each side seal attachment portion by a double-sided adhesive tape or an adhesive agent.

The lower film 76 serves to prevent toner leakage from between the outer circumferential surface of the developing roller 71 and the developing casing 70. The lower film 76 extends in the left-to-right direction and is in sliding contact with the outer circumferential surface of the developing roller 71. The lower film 76 is made of a sheet-like material having resiliently deformable characteristics, such as a PET (polyethylene terephthalate) sheet or a rubber sheet.

The lower film 76 is fixed to the lower film attachment portion of the developing casing 70 by a double-sided adhesive tape, for example. The lower film 76 extends in the left-to-right direction such that, when attached to the developing casing 70, the widthwise end portions of the lower film 76 extend beyond the lower film attachment portion and are placed on (over) the side sealing members 74 respectively, as shown in FIG. 5B.

The blade sealing members 75 are fitted into the grooves 15 between the pressing portion 12B and each engagement portion 12C to prevent toner from leaking outside from therebetween.

As shown in FIGS. 5B and 6, the blade sealing member 75 has a substantially rectangular shape in a plan view. Each blade sealing member 75 is positioned outward of the region D of the developing roller 71 in the left-to-right direction. In other words, each blade sealing member 75 is disposed outward of each widthwise end portion of the opening 70*b* in the left-to-right direction. Each blade sealing member 75 has an upstream end that is in contact with each side sealing member 74 in the rotational direction X of the developing roller 71, as shown in FIG. 5B.

Each blade sealing member 75 has a length L2 greater than the length L1 of the groove 15 in the left-to-right direction, as shown in FIG. 6. More specifically, the blade sealing member 75 has the length L2 of 5.5 mm in the left-to-right direction and a depth (length) H2 of 1.3 mm in the vertical direction.

Each blade sealing member 75 is configured of a base member 17 and a fluffy-surfaced portion 16.

The base member 17 is made of an elastically deformable member, such as urethane sponge. The fluffy-surfaced portion 16 is raised (or napped) by weaving minute Teflon (registered trademark) fibers into a ground fabric woven by polyester warp and cotton woof. The fluffy-surfaced portion 16 is attached to the base member 17 by a double-sided adhesive tape. As shown in FIGS. 5B and 5C, each fluff of the fluffy-surfaced portion 16 is laid down and diagonally inclined such that, in the rotational direction X, a downstream end of the fluff is positioned nearer to a laterally center of the opening 70*b* than an upstream end of the fluff to the laterally center of the opening 70*b*. In other words, in FIG. 5B, each fluff is laid down and inclined diagonally rearward and leftward.

The fluffy-surfaced portion 16 and the base member 17 have a length identical to each other in the left-to-right direction (i.e., the length L2), but have a height (or a length in the vertical direction) different from each other. More specifically, the base member 17 has a height of 0.4 mm, the fluffy-surfaced portion 16 has a height of 0.75 mm, and the double-sided adhesive tape interposed between the fluffy-surfaced portion 16 and the base member 17 has a height of 0.15 mm in the vertical direction.

The blade sealing member 75 of the above-configuration has a hardness of seventy-five (75) degrees as a result of measurement by the durometer (CL-150, a product of KOBUNSHI KEIKI co. ltd.). In other words, the blade sealing member 75 has a hardness lower than that of the engagement portion 12C.

When the blade sealing member 75 is fitted with the groove 15, an outer peripheral portion 75*b* of the blade sealing member 75 is brought into intimate-contact with the inner wall section 12*e* of the engagement portion 12C, while an inner peripheral portion 75*a* of the blade sealing member 75 is brought into intimate-contact with the outer wall section 12*d* of the pressing portion 12B. Thus, each blade sealing member 75 serves to prevent toner leakage from between each outer wall section 12*d* of the pressing portion 12B and the inner peripheral portion 75*a* of each blade sealing member 75.

As shown in FIG. 7, when the developing roller 71 is assembled to the developing casing 70, the blade sealing members 75, the pressing portion 12B and the engagement portions 12C all elastically deform to have a height identical to one another.

As described above, the pressing portion 12B and each engagement portion 12C define each groove 15 on both widthwise end portions of the leaf spring member 12A. The groove 15 has the length L1 smaller than the length L2 of the blade sealing member 75 in the left-to-right direction. Therefore, when the blade sealing member 75 is fitted with the groove 15, both widthwise ends of the groove 15 in the left-to-right direction (i.e., the outer wall section 12*d* of the pressing portion 12B and the inner wall section 12*e* of the engagement portion 12C) can be brought into pressure-contact with the widthwise end portions of the blade sealing member 75 (i.e., the inner peripheral portion 75*a* and the outer peripheral portion 75*b*).

In other words, only fitting the blade sealing member 75 into the groove 15 brings the inner peripheral portion 75*a* of the blade sealing member 75 and the outer wall section 12*d* and the outer wall section 12*d* of the pressing portion 12B into intimate-contact with each other. Therefore, the blade sealing member 75 can prevent toner from flowing outside of the developing casing 70 from between the inner peripheral portion 75*a* and the outer wall section 12*d*. That is, there is no need to use a double-sided adhesive tape to fix the blade sealing member 75 to the leaf spring member 12A. Assembling the blade sealing member 75 to the leaf spring member 12A is thus facilitated.

Further, according to the fluffy-surfaced portion 16 of the blade sealing member 75 of the embodiment, each fluff is laid down and diagonally inclined such that, in the rotational direction X, a downstream end of the fluff is positioned nearer to a laterally center of the opening 70*b* than an upstream end of the fluff to the laterally center of the opening 70*b*. Therefore, even if toner is flowing to the fluffy surface portion 16 of the blade sealing member 75, toner is moved along the fluffs to flow back to the opening 70*b*. As a result, toner leakage from the opening 70*b* can be effectively prevented.

<First Modification>

Contrary to the groove 15 of the embodiment, a groove 151 according to a first modification of the embodiment is formed with saw-like surface irregularities. More specifically, as shown in FIG. 7A, a bottom surface 115*f* of the groove 151 with which the blade sealing member 75 is brought into direct contact when assembled to the leaf spring member 12A has a saw-like shaped irregularities. Each saw teeth is oriented inward in the left-to-right direction, i.e., toward a center portion of the opening 70*b*.

The saw-like surface irregularities may be formed by processing the bottom surface 115*f* (i.e., a surface of the leaf spring member 12A interposed between the outer wall section 12*d* and the inner wall section 12*e*), or alternatively by attaching a separate saw-like shaped member to the bottom surface 115*f*.

When the blade sealing member 75 is assembled to the groove 115, the blade sealing member 75 is first brought into abutment with tip ends of the saw tooth formed on the lower surface 115*f*. As the blade sealing member 75 is further pushed into the groove 115, the tip ends of the saw tooth are laid down such that the blade sealing member 75 is moved inward in the left-to-right direction. That is, when assembled to the groove 115, the outer wall section 12*d* of the pressing portion 12B and the inner peripheral portion 75*a* of the blade sealing member 75 can be brought into intimate-contact with each other.

As shown in FIG. 7B, when the developing roller 71 is assembled to the developing casing 70, the blade sealing members 75 are constantly in contact with the widthwise end portions of the developing roller 71. The blade sealing member 75 is therefore constantly being pushed toward the outer wall section 12*d* of the pressing portion 12B when the developing roller 71 is assembled to the opening 70*b*.

With this configuration, the blade sealing members 75 can be assembled to the groove 115 such that each blade sealing member 75 is moved toward each outer wall section 12*d* of the pressing portion 12B. As a result, the blade sealing members 75 can be in contact with the corresponding outer wall sections 12*d* of the pressing portion 12B more tightly and intimately, thereby effectively suppressing toner leakage.

<Second Modification>

Figure 8:
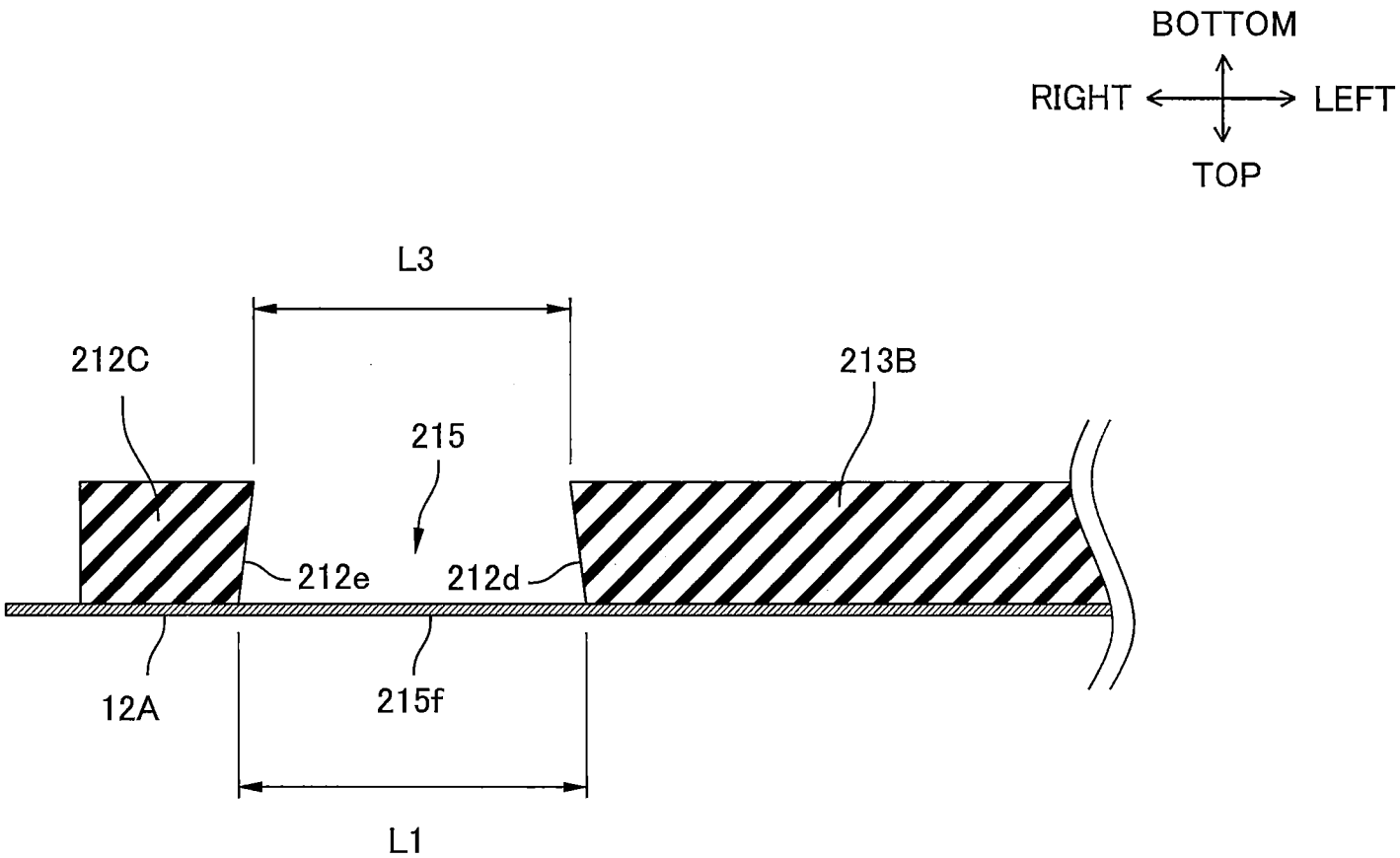
FIG. 8 is a partially-enlarged schematic view showing a groove according to a second modification of the embodiment as viewed from its front side.

FIG. 8 shows a groove 215 according to a second modification of the embodiment.

The groove 215 defines an open end facing the developing roller 71 and a lower surface 215*f* in direct confrontation with the blade sealing member 75 when the blade sealing member 75 is assembled to the groove 215. In a front side view, an outer wall section 212*d* and an inner wall section 212*e* slope toward the open end such that the open end has a length L3 shorter than the length L1 of the groove 215 (a length of the lower surface 215*f*) in the left-to-right direction. More specifically, the length L3 of the open end of the groove 215 is 3.85 mm in the left-to-right direction (the length L1 remains the same as 4.85 mm of the embodiment).

With this configuration, when each blade sealing member 75 has been assembled to the corresponding groove 215, the blade sealing member 75 is restricted from moving toward the open end (toward the developing roller 71). Therefore, a gap is suppressed from being formed between the pressing portion 12B and the blade sealing member 75, leading to further suppression of toner leakage.

<Third Modification>

Figure 9:
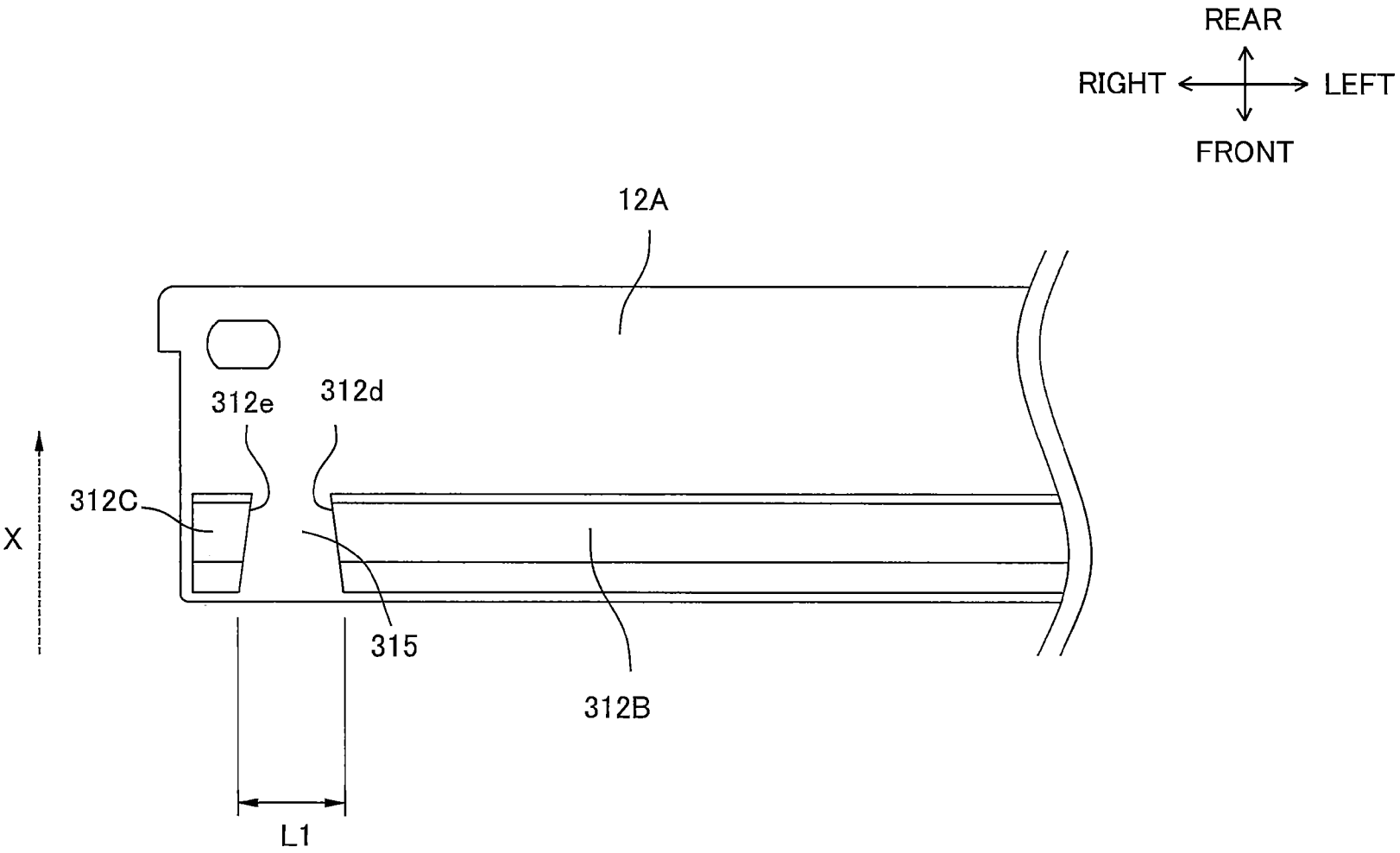
FIG. 9 is a partially-enlarged schematic view showing a groove according to a third modification of the embodiment as viewed from its bottom side.

FIG. 9 shows a groove 315 according to a third modification of the embodiment.

In the third modification, as shown in FIG. 9, the groove 315 is formed such that, when viewed from below, an outer wall section 312*d* of a pressing portion 312B and an inner wall section 312*e* of each engagement portion 312C form a tapered shape as the groove 315 extends downstream in the rotational direction X. In other words, a distance between the outer wall section 312*d* and the inner wall section 312*e* becomes shorter toward the rear side in FIG. 9.

With this configuration, the groove 315 can prevent the corresponding blade sealing member 75 from moving in the rotational direction X when the developing roller 71 is rotating. As a result, forming a gap between the pressing portion 312B and the blade sealing members 75 can be suppressed, leading to further suppression of toner leakage.

As an alternative to the third modification, the blade sealing member 75 may be formed into a shape identical to that of the groove 315. In this case as well, the tapered-shaped blade sealing member 75 has a length in the left-to-right direction greater than the distance between the between the outer wall section 312*d* and the inner wall section 312*e*, as in the embodiment.

<Fourth Modification>

A groove 415 according to a fourth modification of the embodiment will be described. In the groove 415, an outer wall section 412*d* of a pressing portion 412B and an inner wall section 412*e* of each engagement portion 412C may be connected to each other in the rotational direction X.

With this configuration, formation of the pressing portion 412B and the engagement portions 412C on the leaf spring member 12A is facilitated since injecting the elastic material into the mold becomes easier.

<Fifth Modification>

Figure 10:
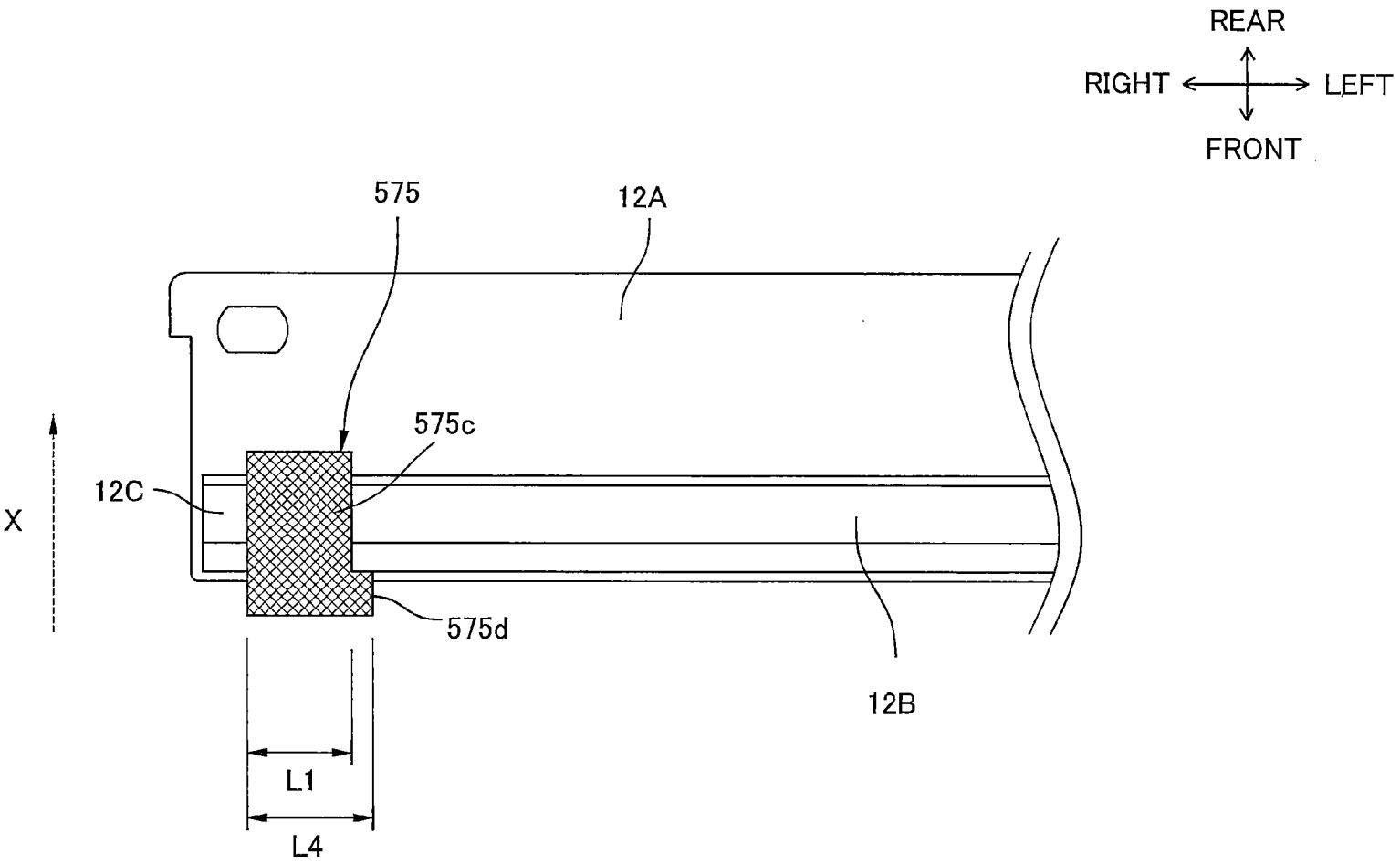
FIG. 10 is a partially-enlarged schematic view showing a blade sealing member according to a fifth modification of the embodiment as viewed from its bottom side.

FIG. 10 shows a blade sealing member 575 according to a fifth modification of the embodiment.

In contrast to the substantially rectangular-shaped blade sealing member 75 of the embodiment, the blade sealing member 575 of the fifth modification has a substantially L shape in a plan view.

More specifically, as shown in FIG. 10, the blade sealing member 575 of the fifth modification includes a main portion 575*c* and a protruding portion 575*d* protruding from the main portion 575*c* frontward in the rotational direction X and inward in the left-to-right direction. The main portion 575*c* corresponds to the blade sealing member 75 of the embodiment. When fitted with the groove 15, the protruding portion 575*d* is engaged with the pressing portion 12B in the left-to-right direction. The protruding portion 575*d* has a length L4 greater than the length L1 of the groove 15 in the left-to-right direction. Specifically, the protruding portion 575*d* has the length L4 of 7.0 mm, while the length L1 remains 4.85 mm as in the embodiment.

With this configuration, the protruding portion 575*d* can be engaged with the pressing portion 12B even though the blade sealing member 575 is urged to move downstream in the rotational direction X in accordance with rotation of the developing roller 71. Therefore, the blade sealing member 575 can restrict the blade sealing member 575 from moving in the rotational direction X. Toner leakage from between the pressing portion 12B and the blade sealing member 575 can be further suppressed.

<Sixth Modification>

Figure 11:
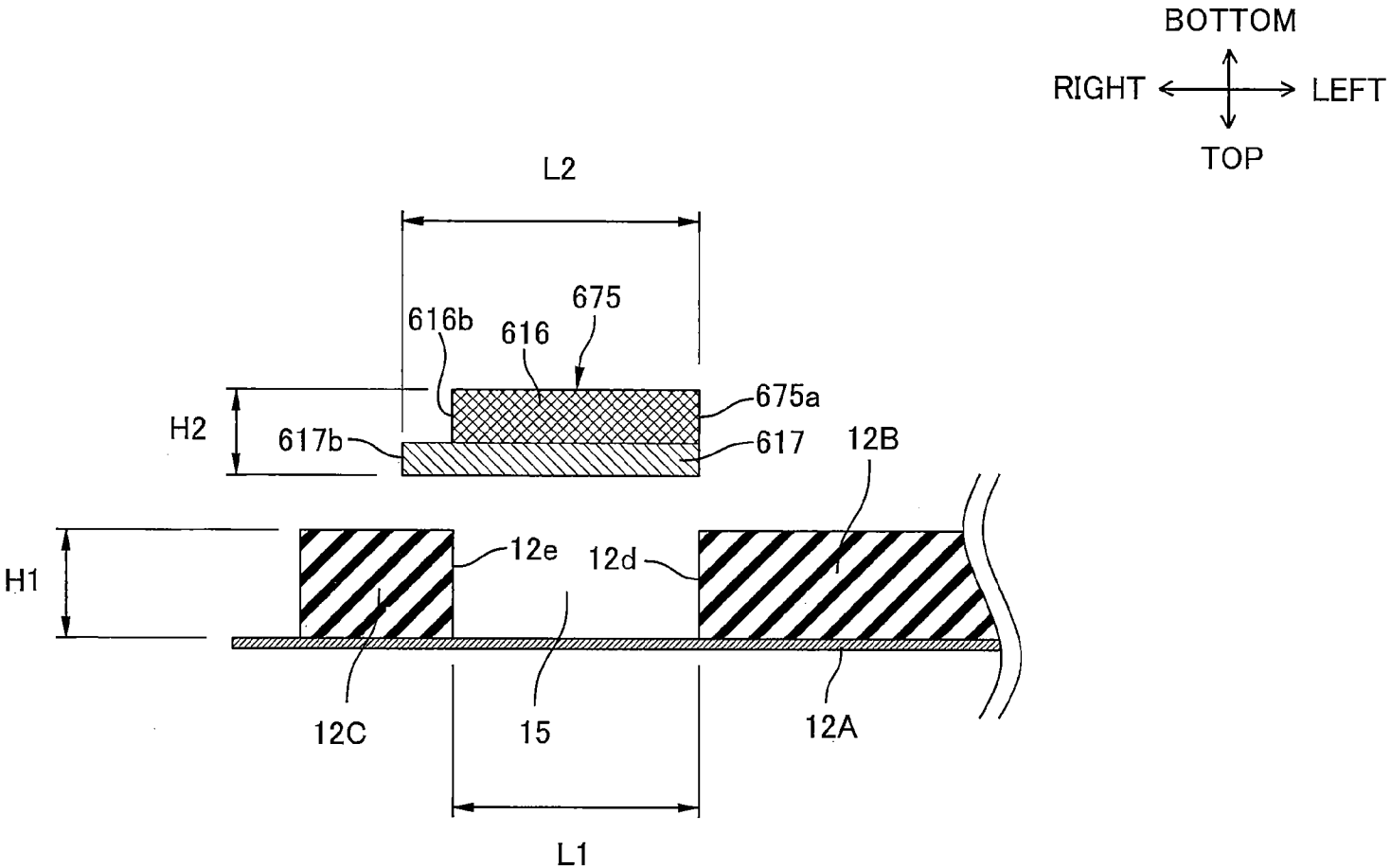
FIG. 11 is a partially-enlarged schematic view showing a blade sealing member according to a sixth modification of the embodiment as viewed from its front side.

FIG. 11 shows a blade sealing member 675 according to a sixth modification of the embodiment.

In the embodiment, the blade sealing member 75 is configured of the base member 17 and the fluffy-surfaced portion 16 both having the same length as each other in the left-to-right direction (i.e., the length L2). In contrast, the blade sealing member 675 of the sixth modification includes a base member 617 and a fluffy-surfaced portion 616 having a length different from each other in the left-to-right direction.

More specifically, shown in FIG. 11, the base member 617 has an outer end 617*b* positioned outward of an outer end 616*b* of the fluffy-surfaced portion 616 in the left-to-right direction. In other words, the fluffy-surfaced portion 616 has a length shorter than the length L2 of the base member 617 in the left-to-right direction.

With this configuration, the fluffy-surfaced portion 616 is subjected to less elastic deformation than the base member 617 when the blade sealing member 675 is fitted with the groove 15. Therefore, the fluffy-surfaced portion 616 is prevented from being pushed up when the blade sealing member 675 is fitted with the groove 15, thereby suppressing fluffs of the fluffy-surfaced portion 616 from being laid down in directions different from one another. In other words, the toner flowing to the blade sealing member 675 can move along each fluff toward the opening 70*b* without heading for somewhere else. As a result, the toner can flow back to the opening 70*b*, thereby leading to further suppression of toner leakage.

While the invention has been described in detail with reference to the embodiments thereof, it would be apparent to those skilled in the art that various changes and modifications may be made therein without departing from the spirit of the invention.

What is claimed is:

1. A developing device comprising:

a casing having an opening extending in a first direction;

a developing roller positioned adjacent to the opening and configured to rotate about an axis extending in the first direction, the developing roller having an outer circumferential surface on which developer is carried;

a thickness-regulation member comprising:

a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion, the regulating portion being in contact with the outer circumferential surface of the developing roller via the developer for regulating thickness of the developer on the outer circumferential surface, the regulating portion having an end face extending in a direction crossing the first direction;

an engagement portion fixed on the thin-plate member and positioned closer to the lateral end than the end face is to the lateral end to provide a groove between the engagement portion and the end face, the groove having a length in the first direction; and a sealing member fitted in the groove for suppressing leakage of the developer from the casing, the sealing member having a length in the first direction longer than the length of the groove prior to assembly of the sealing member into the groove.

2. The developing device according to claim 1, wherein the groove defines on the thin-plate member a bottom surface in direct confrontation with the sealing member when the sealing member is fitted with the groove, the bottom surface being formed with saw-teeth like surface irregularities whose tip end portions are oriented toward a center portion of the opening in the first direction.

3. The developing device according to claim 1, wherein the groove defines a bottom surface in direct confrontation with the sealing member when the sealing member is fitted with the groove and an open end facing the developing roller, the open end having a length in the first direction shorter than the length of the bottom surface.

4. The developing device according to claim 1, wherein the developing roller is configured to rotate in a rotating direction perpendicular to the first direction;

wherein the engagement portion has an end surface opposing the end face of the regulating portion; and wherein the groove has a bottom surface in direct confrontation with the sealing member when the sealing member is fitted with the groove and a pair of first and second side surfaces spaced away from each other in the first direction, the first side surface being the end face of the regulating portion and the second side surface being the end surface of the engagement portion, a distance between the pair of first and second side surfaces being gradually decreased in the rotating direction.

5. The developing device according to claim 1, wherein the developing roller is configured to rotate in a rotating direction perpendicular to the first direction and;

wherein the sealing member includes a main portion fitted in the groove, and a protruding portion protruding from the main portion toward upstream in the rotating direction and also protruding in the first direction toward a center portion of the opening to engage the regulating portion when the sealing member is fitted with the groove.

6. The developing device according to claim 1, wherein the developing roller is configured to rotate in a rotating direction perpendicular to the first direction and;

wherein the sealing member comprises an elastic base member and a fluffy-surfaced member provided on the base member, the fluffy-surfaced member including a plurality of fluffs each having a base end and a free end, each fluff being diagonally inclined such that the base end is positioned upstream of the free end in the rotating direction and the free end is positioned nearer to a center portion of the opening in the first direction than the base end to the center portion of the opening.

7. The developing device according to claim 6, wherein the base member has an outer end face and an inner end face spaced away from each other in the first direction, and;

wherein the fluffy-surfaced member has an outer end face and an inner end face spaced away from each other in the first direction, the outer end face of the base member is positioned closer to the lateral end than the outer end face of the fluffy-surfaced member is to the lateral end prior to assembly of the sealing member into the groove.

8. The developing device according to claim 1, wherein the thin-plate member has a first lateral end and a second lateral end spaced away from each other in the first direction; and wherein the regulating portion has a first end face and a second end face spaced away from each other in the first direction; and wherein the engagement portion comprises a first engagement portion positioned closer to the first lateral end than the first end face is to the first lateral end to provide a first groove between the first engagement portion and the first end face, and the second engagement portion positioned closer to the second lateral end than the second end face is to the second lateral end to provide a second groove between the second engagement portion and the second end face; and wherein the sealing member comprises a first sealing member fitted in the first groove and having a length in the first direction greater than a length of the first groove, and the second sealing member fitted in the second groove and having a length in the first direction greater than a length of the second groove prior to assembly of the first sealing member and the second sealing member into the first groove and the second groove respectively.

9. A process unit comprising:

a photosensitive member having a circumferential surface on which an electrostatic latent image is formed; and a developing device for supplying developer to the electrostatic latent image, the developing device comprising:

a casing having an opening extending in a first direction;

a developing roller positioned adjacent to the opening and configured to rotate about an axis extending in the first direction, the developing roller having an outer circumferential surface on which developer is carried;

a thickness-regulation member comprising:

a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion, the regulating portion being in contact with the outer circumferential surface of the developing roller via the developer for regulating thickness of the developer on the outer circumferential surface, the regulating portion having an end face extending in a direction crossing the first direction;

an engagement portion fixed on the thin-plate member and positioned closer to tie lateral end than the end face is to the lateral end to provide a groove between the engagement portion and the end face, the groove having a length in the first direction; and a sealing member fitted in the groove for suppressing leakage of the developer from the casing, the sealing member having a length in the first direction longer than the length of the groove prior to assembly of the sealing member into the groove.

10. An image forming device comprising:

a process unit comprising:

a photosensitive member having a circumferential surface on which an electrostatic latent image is formed; and a developing device for supplying developer to the electrostatic latent image to form a developer image, the developing device comprising:

a casing having an opening extending in a first direction;

a developing roller positioned adjacent to the opening and configured to rotate about an axis extending in the first direction, the developing roller having an outer circumferential surface on which developer is carried;

a thickness-regulation member comprising:

a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion, the regulating portion being in contact with the outer circumferential surface of the developing roller via the developer for regulating thickness of the developer on the outer circumferential surface, the regulating portion having an end face extending in a direction crossing the first direction;

an engagement portion fixed on the thin-plate member and positioned closer to the lateral end than the end face is to the lateral end to provide a groove between the engagement portion and the end face, the groove having a length in the first direction; and a sealing member fitted in the groove for suppressing leakage of the developer from the casing, the sealing member having a length in the first direction longer than the length of the groove prior to assembly of the sealing member into the groove;

an exposure unit that exposes a scanned light to the photosensitive member;

a transfer unit that transfers a developer image formed in the process unit to a sheet; and a fixing unit that fixes the developer image to the sheet.

* * * * *